US007418833B2

(12) United States Patent
Kato et al.

(10) Patent No.: US 7,418,833 B2
(45) Date of Patent: Sep. 2, 2008

(54) REFRIGERATION APPARATUS

(75) Inventors: Ryogo Kato, Osaka (JP); Yoshitaka Shibamoto, Osaka (JP)

(73) Assignee: Daikin Industries, Ltd., Osaka-Shi, Osaka (JP)

( * ) Notice: Subject to any disclaimer, the term of this patent is extended or adjusted under 35 U.S.C. 154(b) by 227 days.

(21) Appl. No.: 10/562,461

(22) PCT Filed: Jul. 26, 2004

(86) PCT No.: PCT/JP2004/010620

§ 371 (c)(1),
(2), (4) Date: Dec. 27, 2005

(87) PCT Pub. No.: WO2005/010370

PCT Pub. Date: Feb. 3, 2005

(65) Prior Publication Data

US 2006/0150670 A1 Jul. 13, 2006

(30) Foreign Application Priority Data

Jul. 28, 2003 (JP) ..... 2003-281171

(51) Int. Cl.
*F25B 1/00* (2006.01)

(52) U.S. Cl. ..... 62/498; 62/525

(58) Field of Classification Search ..... 62/498, 62/510, 525

See application file for complete search history.

(56) References Cited

U.S. PATENT DOCUMENTS

| | | | | |
|---|---|---|---|---|
| 4,505,122 | A * | 3/1985 | Inomata | 62/133 |
| 4,726,739 | A * | 2/1988 | Saitou et al. | 417/286 |
| 5,103,652 | A * | 4/1992 | Mizuno et al. | 62/505 |
| 5,322,424 | A | 6/1994 | Fujio | |
| 5,863,190 | A * | 1/1999 | Yamamoto et al. | 418/55.1 |
| 2002/0106294 | A1 | 8/2002 | Nakane et al. | |

FOREIGN PATENT DOCUMENTS

| | | |
|---|---|---|
| CN | 50-72205 | 6/1975 |
| JP | 50-72205 | 6/1975 |
| JP | 5-133366 A | 5/1993 |
| JP | 2002-235682 A | 8/2002 |
| JP | 2002-349980 A | 12/2002 |

* cited by examiner

*Primary Examiner*—Melvin Jones
(74) *Attorney, Agent, or Firm*—Birch, Stewart, Kolasch and Birch, LLP

(57) ABSTRACT

A refrigeration apparatus, provided with a refrigerant circuit (90) having a plurality of refrigerant circulating routes and capable of operation in a mode where the plurality of refrigerant circulating routes differ in refrigerant evaporation temperature and/or in refrigerant condensation temperature, is activated by a single scroll compressor (10) including a casing (11) in which are arranged two compression mechanisms (31, 32), thereby making it possible to accomplish install-space savings, cost-cutting, and high-efficiency operation.

7 Claims, 11 Drawing Sheets

REFRIGERATION APPARATUS

TECHNICAL FIELD

The present invention relates to refrigeration apparatuses and more specifically to a refrigeration apparatus provided with a refrigerant circuit having a plurality of refrigerant circulating routes and capable of operation in a mode where the plurality of refrigerant circulating routes differ in refrigerant evaporation temperature and/or refrigerant condensation temperature.

BACKGROUND ART

Refrigeration apparatuses which perform refrigeration cycles are known in the prior art. Such a type of refrigeration apparatus has been used widely as an air conditioner for providing room cooling/heating and a cooling machine such as a refrigerator, freezer or showcase for the storage of foods. Some refrigeration apparatuses provide both room cooling and refrigerator's storage space cooling (for example, see Japanese Patent Application Kokai Publication No. 2002-349980). This type of refrigeration apparatus is generally installed in convenience stores.

With reference to FIG. 11 showing a refrigerant circuit (100) of the above-described refrigeration apparatus, discharge pipes of two compressors (101, 102) join and their junction is linked to a single high-pressure gas pipe (103). The high-pressure gas pipe (103) is linked to one end of an outdoor heat exchanger (104). The other end of the outdoor heat exchanger (104) is branch-connected, through a liquid pipe (107), to one end of an air-conditioning heat exchanger (105) for room air-conditioning and to one end of a cooling heat exchanger (106) for refrigerator's storage space cooling. Branch pipes (108, 109) of the liquid pipe are provided with expansion valves (110, 111), respectively. And, the other end of the air-conditioning heat exchanger (105) is connected, through a first low-pressure gas pipe (112), to the suction side of the first compressor (101). The other end of the cooling heat exchanger (106) is connected, through a second low-pressure gas pile (113), to the suction side of the second compressor (102). By virtue of the above-described arrangement, the temperature at which refrigerant evaporates in the air-conditioning heat exchanger (105) differs from the temperature at which refrigerant evaporates in the cooling heat exchanger (106).

Problems that Invention Intends to Solve

In the above-described conventional refrigeration apparatus, however, each refrigerant circulating route requires a respective compressor, in other words the provision of the compressors (101, 102) is required. Consequently, the installation of the compressors (101, 102) requires a large space. Another problem is that the provision of the two compressors (101, 102) increases costs in comparison with the provision of a single compressor.

With the above-described problems in mind, the present invention was made. Accordingly, an object of the present invention is to accomplish installation space reduction and cost reduction by enabling a single compressor to activate a refrigeration apparatus provided with a refrigerant circuit having a plurality of refrigerant circulating routes and capable of operation in a mode where the plurality of refrigerant circulating routes differ in refrigerant evaporation temperature and/or refrigerant condensation temperature.

DISCLOSURE OF INVENTION

In the present invention, a compressor with two compression mechanisms (31, 32) contained in a single casing (11) is used in a refrigerant circuit (90) having a plurality of refrigerant circulating routes.

More specifically, the present invention is directed to a refrigeration apparatus provided with a refrigerant circuit (90) having a plurality of refrigerant circulating routes and capable of operation in a mode where the plurality of refrigerant circulating routes differ in at least one of refrigerant evaporation temperature and refrigerant condensation temperature.

A first invention is characterized in that a compressor (10) of the refrigerant circuit (90) comprises a single casing (11) in which a first compression mechanism (31) linked to a first refrigerant circulating route and a second compression mechanism (32) linked to a second refrigerant circulating route are arranged.

In the first invention, refrigerant discharged from the first compression mechanism (31) circulates through the first refrigerant circulating route of the refrigerant circuit (90) while, on the other hand, refrigerant discharged from the second compression mechanism (32) circulates through the second refrigerant circulating route of the refrigerant circuit (90).

The second invention is characterized in that in the refrigeration apparatus of the first invention the first and second compression mechanisms (31, 32) differ from each other in compression ratio.

In the second invention, refrigerant discharged from the first compression mechanism (31) circulates through the first refrigerant circulating route of the refrigerant circuit (90) while, on the other hand, refrigerant discharged from the second compression mechanism (32) circulates through the second refrigerant circulating route of the refrigerant circuit (90). Since the first compression mechanism (31) and the second compression mechanism (32) differ from each other in compression ratio, this makes it possible to provide to each refrigerant circulating route a supply of refrigerant at a respective suitable pressure.

A third invention is characterized in that in the refrigeration apparatus of the first invention the first and second compression mechanisms (31, 32) differ from each other in displacement volume.

In the third invention, refrigerant discharged from the first compression mechanism (31) circulates through the first refrigerant circulating route of the refrigerant circuit (90) while, on the other hand, refrigerant discharged from the second compression mechanism (32) circulates through the second refrigerant circulating route of the refrigerant circuit (90). Since the first compression mechanism (31) and the second compression mechanism (32) differ from each other in displacement volume, this makes it possible to provide to each refrigerant circulating route a supply of refrigerant at a respective suitable circulation amount.

A fourth invention is characterized in that in the refrigeration apparatus of any one of the first to third inventions the first and second compression mechanisms (31, 32) are scroll compression mechanisms; an orbiting scroll (50) integrated by sequentially layering a first flat-plate part (51), a first movable-side wrap (53), a second flat-plate part (52) and a second movable-side wrap (54), and a fixed scroll (40) having a first stationary-side wrap (42) which engages the first movable-side wrap (53) and a second stationary-side wrap (47) which engages the second movable-side wrap (54) are provided; the first stationary-side wrap (42) and the first movable-side wrap (53) together form the first compression mechanism (31); and the second stationary-side wrap (47) and the second movable-side wrap (54) together form the second compression mechanism (32).

In the fourth invention, the refrigerant circuit (90), having the two refrigerant circulating routes and capable of operation in a mode where the two refrigerant circulating routes differ in refrigerant evaporation temperature and/or refrigerant condensation temperature, is activated by the single compressor formed by the two-tiered compression mechanisms (31, 32) wherein the first compression mechanism (31) comprises the first stationary-side wrap (42) and the first movable-side wrap (53) while, on the other hand, the second compression mechanism (32) comprises the second stationary-side wrap (47) and the second movable-side wrap (54).

A fifth invention is characterized in that in the refrigeration apparatus of any one of the first to third inventions the first and second compression mechanisms (31, 32) are scroll compression mechanisms; an orbiting scroll (50) having a first movable-side wrap (53) formed in standing manner on one surface of a flat-plate part (55) and a second movable-side wrap (54) formed in standing manner on the other surface of the flat-plate part (55), and a fixed scroll (40) having a first stationary-side wrap (42) which engages the first movable-side wrap (53) and a second stationary-side wrap (47) which engages the second movable-side wrap (54) are provided; the first stationary-side wrap (42) and the first movable-side wrap (53) together form the first compression mechanism (31); and the second stationary-side wrap (47) and the second movable-side wrap (54) together form the second compression mechanism (32).

In the fifth invention, the refrigerant circuit (90), having the two refrigerant circulating routes and capable of operation in a mode where the two refrigerant circulating routes differ in refrigerant evaporation temperature and/or refrigerant condensation temperature, is activated by the single compressor having the first compression mechanism (31) and the second compression mechanism (32) which are disposed opposite to each other with the flat-plate part (55) of the orbiting scroll (50) lying therebetween.

Effects

In accordance with the first invention, the scroll compressor (10) of the refrigerant circuit (90) has, in the single casing (11), the first compression mechanism (31) linked to the first refrigerant circulating route and the second compression mechanism (32) linked to the second refrigerant circulating route. In other words, the provision of a single compressor (i.e., the scroll compressor (10)) makes it possible to accomplish install-space savings and apparatus cost reduction.

If each refrigerant circulating route is provided with a respective compressor, this increases the number of points requiring welding and brazing. Consequently, refrigerant leakage due to aged deterioration and vibrations of the apparatus may occur, thereby making the apparatus less efficient and producing factors causing global warming. The present invention makes these problems avoidable because it employs only one compressor (i.e., the scroll compressor (10)).

In accordance with the second invention, the first compression mechanism (31) and the second compression mechanism (32) differ from each other in compression ratio, thereby making it possible to perform, at the ratio of the condensation pressure and the evaporation pressure of each refrigerant circulating route (i.e., at the pressure ratio), efficient compression without losses such as over-compression and compression insufficiency in the refrigerant circuit (90).

In accordance with the third invention, the first compression mechanism (31) and the second compression mechanism (32) differ from each other in displacement volume, thereby making it possible to provide to each refrigerant circulating route of the refrigerant circuit (90) a supply of refrigerant at a respective suitable circulation amount.

In accordance with the fourth invention, it employs a compressor formed by the two-tiered compression mechanisms (31, 32) of the scroll type, thereby making it possible to achieve considerable downsizing of the apparatus. Furthermore, it is possible to form the first compression mechanism (31) and the second compression mechanism (32) by using two stationary-side wraps and two movable-side wraps of a conventional scroll compressor provided with a single compression mechanism. This makes it possible to achieve a share of component parts with the conventional scroll compressor, thereby achieving cost-cutting.

In accordance with the fifth invention, it employs the orbiting scroll (50) having the first movable-side wrap (53) formed in a standing manner on one surface of the flat-plate part (55) and the second movable-side wrap (54) formed in a standing manner on the other surface of the flat-plate part (55), thereby making it possible to reduce the number of component parts and to achieve cost-cutting.

BEST MODE FOR CARRYING OUT INVENTION

Hereinafter, preferred embodiments of the present invention are described with reference to the drawings. Each of the following embodiments relates to a refrigeration apparatus provided with a refrigerant circuit whose compression mechanism is formed by a scroll compressor.

First Embodiment of Invention

A first embodiment of the present invention is now described, starting with its scroll compressor.

Figure 1:
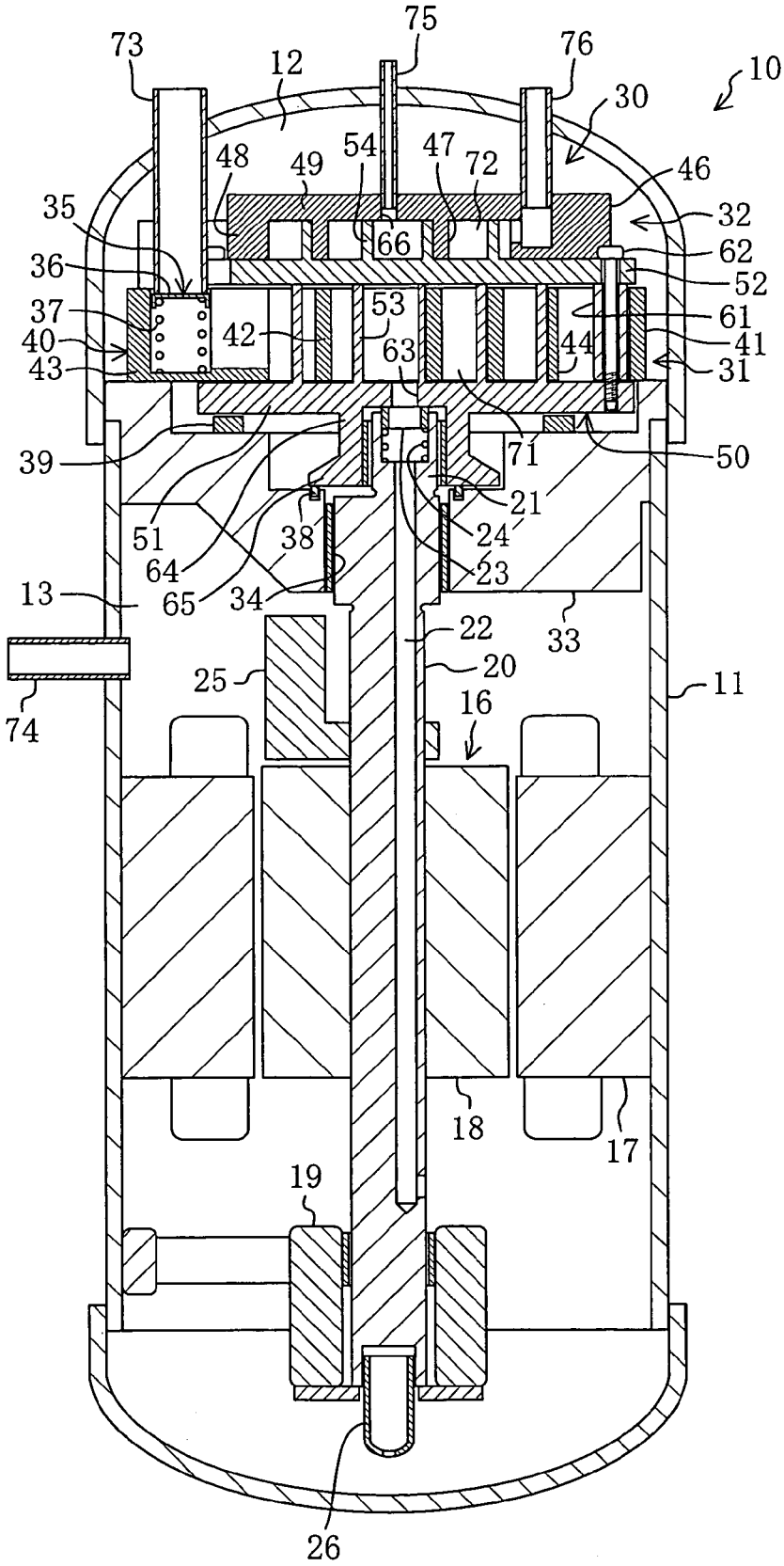
FIG. 1 is a schematic cross sectional view showing the arrangement of a scroll compressor in a first embodiment of the present invention.

As shown in FIG. 1, the scroll compressor (10) has a casing (11) shaped like an oblong, cylindrical, hermetically-sealed container. Sequentially arranged from top to bottom in the inside of the casing (11) are a main mechanism (30), an electric motor (16), and a lower bearing (19). In addition, a drive shaft (20) vertically extending in the inside of the casing (11) is mounted as a rotating shaft.

The inside of the casing (11) is separated into up and down by a housing (33) of the main mechanism (30). More specifically, in the inside of the casing (11), the space defined above the housing (33) serves as a low-pressure chamber (12) while, on the other hand, the space defined below the housing (33) serves as a high-pressure chamber (13).

The high-pressure chamber (13) contains the electric motor (16) and the lower bearing (19). The electric motor (16) has a stator (17) and a rotor (18). The stator (17) is firmly attached to a part of the main body of the casing (11). On the other hand, the rotator (18) is firmly attached to a vertically central part of the drive shaft (20). The lower bearing (19) is firmly attached to a part of the main body of the casing (11). The lower bearing (19) rotatably supports the lower end of the drive shaft (20).

The casing (11) has a tube-like discharge port (74) which is a first discharge port. One end of the first discharge port (74) opens to a space at a level above the electric motor (16) in the high-pressure chamber (13).

A main bearing (34) is formed in the housing (33) of the main mechanism (30), such that it vertically passes through the housing (33). The drive shaft (20) is inserted through the main bearing (34). The drive shaft (20) is rotatably supported by the main bearing (34). An upper end portion of the drive shaft (20) projecting above the level of the housing (33) forms an eccentric part (21). The eccentric part (21) is eccentric relative to the central axis of the drive shaft (20).

Attached to a part of the drive shaft (20) situated between the housing (33) and the stator (17) is a balance weight (25). An oil feeding path (not shown) is formed in the drive shaft (20). Refrigeration oil collected on the bottom of the housing (33) is pumped up from the lower end of the drive shaft (20) by action of an oil feeding pump disposed at the lower end of the drive shaft (20). Then, the pumped-up refrigeration oil is supplied, through the oil feeding path, to each section. Furthermore, a discharge path (22) is formed in the drive shaft (20). The discharge path (22) will be described later.

Figure 2:
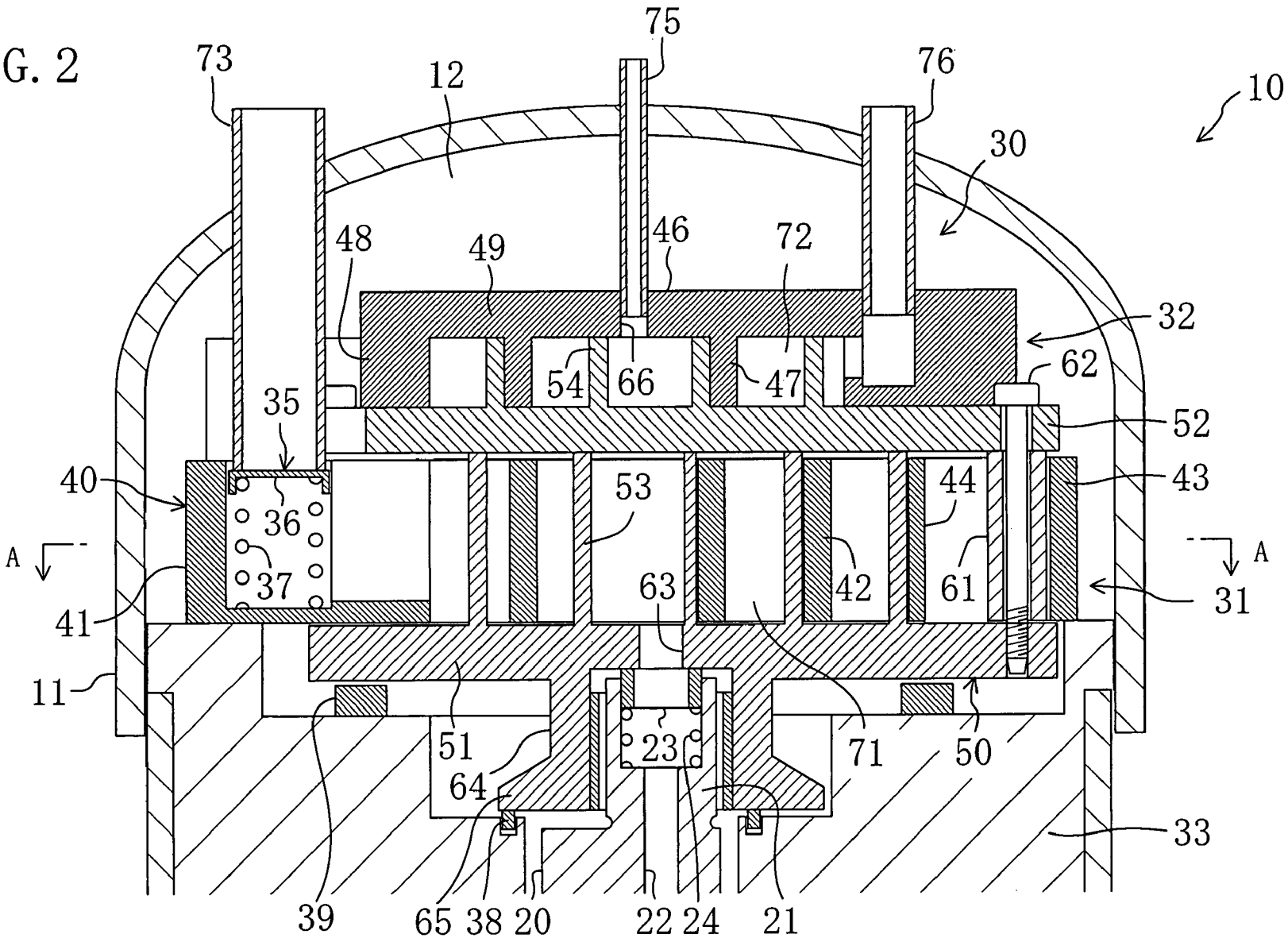
FIG. 2 is an enlarged cross sectional view showing the main part of the scroll compressor of FIG. 1.

As shown in FIG. 2, the low-pressure chamber (12) contains stationary and orbiting scrolls (40, 50) of the main mechanism (30). In the main mechanism (30), a first compression mechanism (31) and a second compression mechanism (32) are formed. The low-pressure chamber (12) further contains an Oldham ring (39).

The fixed scroll (40) is made up of a first stationary-side member (41) and a second stationary-side member (46). The first and second stationary-side members (41, 46) together forming the fixed scroll (40) are firmly attached to the housing (33).

Figure 3:
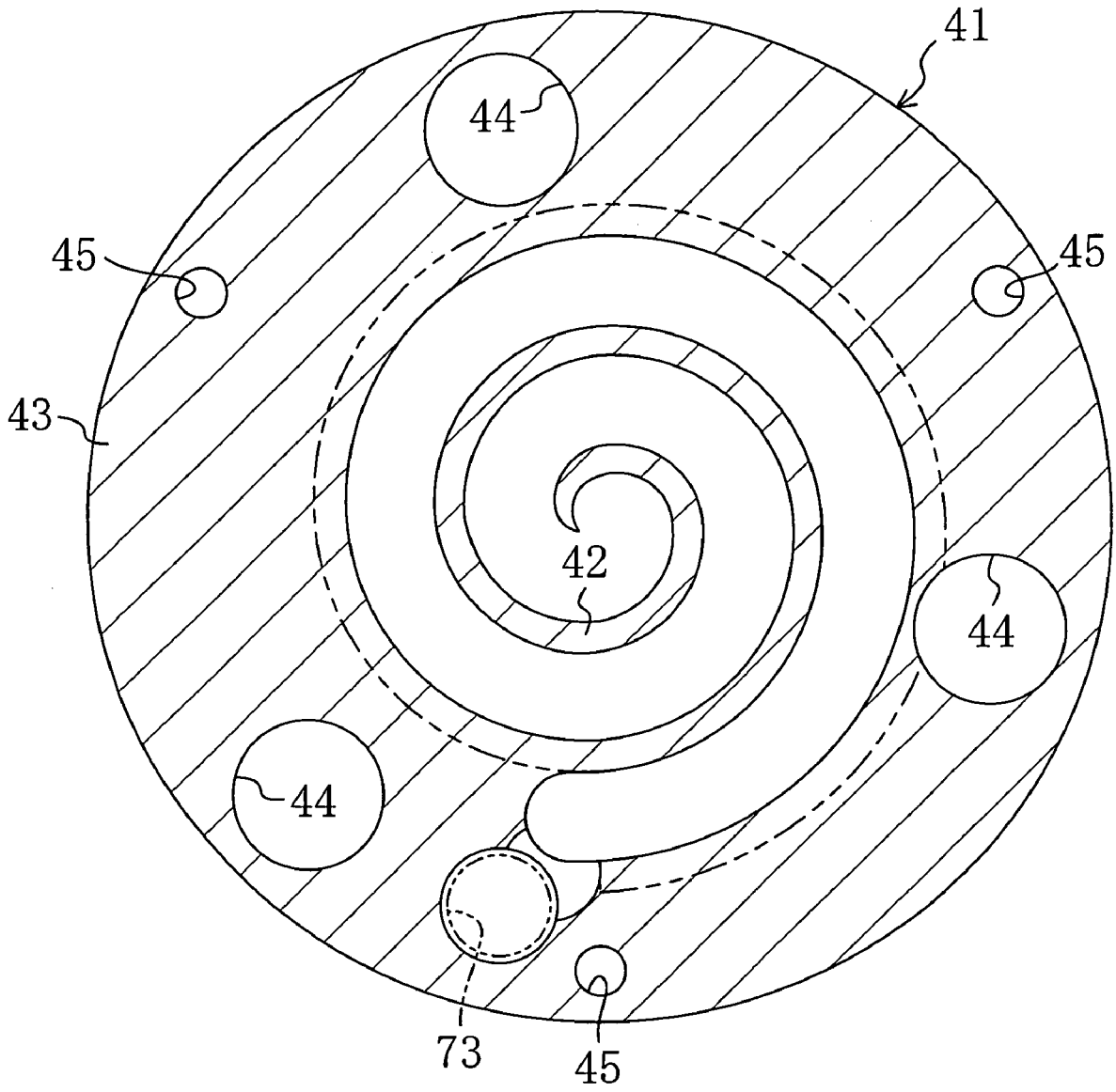
FIG. 3 is a cross sectional view showing a first stationary-side member of a fixed scroll.

As also shown in FIG. 3, the first stationary-side member (41) has a first stationary-side wrap (42) and a first outer peripheral part (43). FIG. 3 is an illustration showing only the first stationary-side member (41) in a cross section taken along the line A-A of FIG. 2.

The first stationary-side wrap (42) is shaped like a spiral wall the height of which is constant. On the other hand, the first outer peripheral part (43) is shaped like a thick ring encompassing the first stationary-side wrap (42). The first outer peripheral part (43) is formed integrally with the first stationary-side wrap (42). In other words, in the first stationary-side member (41), the first stationary-side wrap (42) projects from the inner peripheral surface of the first outer peripheral part (43). In addition, three insertion holes (44) and three bolt holes (45) are formed through the first outer peripheral part (43). The first stationary-side member (41) is firmly fastened, by bolts slid into the bolt holes (45), to the housing (33).

One end of a tube-like suction port (73) which is a first suction port is inserted into the first stationary-side member (41) (see FIG. 2). The first suction port (73) is provided, such that it passes through an upper end portion of the casing (11). A suction check valve (35) is mounted at the bottom of the first suction port (73) in the first stationary-side member (41). The suction check valve (35) is made up of a valve body (36) and a coil spring (37). The valve body (36) is shaped like a cap. The valve body (36) is disposed, such that it closes the lower end of the first suction port (73). In addition, the valve body (36) is pressed against the lower end of the first suction port (73) by the coil spring (37).

As shown in FIG. 2, the second stationary-side member (46) has a second stationary-side wrap (47), a second outer peripheral part (48), and a third flat-plate part (49). The second stationary-side member (46), when viewed as a whole, is shaped like a disc smaller in diameter and thickness than the first stationary-side member (41). The third flat-plate part (49) is shaped like a disc and is disposed at the upper side of the second stationary-side member (46). The second outer peripheral part (48) is formed integrally with the third flat-plate part (49) and extends downwardly from the third flat-plate part (49). The second outer peripheral part (48) is shaped like a thick ring having the same outer diameter as that of the third flat-plate part (49).

In the second stationary-side member (46), the second stationary-side wrap (47) is disposed inside the second outer peripheral part (48). The second stationary-side wrap (47) is formed integrally with the third flat-plate part (49). The second stationary-side wrap (47) is shaped like a spiral wall the height of which is shorter than that of the first stationary-side wrap (42). The second stationary-side wrap (47) extends downwardly from the lower surface of the third flat-plate part (49). In addition, the spiral direction of the second stationary-side wrap (47) is the same as that of the first stationary-side wrap (42). Stated another way, both the first stationary-side wrap (42) and the second stationary-side wrap (47) are shaped like a right-handed spiral wall (see FIG. 3).

One end of a tube-like suction port (76) which is a second suction port is inserted into the second stationary-side member (46). The second suction port (76) is formed, such that it passes through an upper end part of the casing (11). In addition, centrally formed in the third flat-plate part (49) of the second stationary-side member (46) is a discharge opening (66) which is a second discharge opening. The second discharge opening (66) is formed, such that it passes through the third flat-plate part (49). One end of a tube-like discharge port (75) which is a second discharge port is inserted into the second discharge opening (66). The second discharge port (75) is formed, such that it passes through an upper end part of the casing (11).

The orbiting scroll (50) has a first flat-plate part (51), a first movable-side wrap (53), a second flat-plate part (52), a second movable-side wrap (54), and support rod members (61) by which the first flat-plate part (51), the first movable-side wrap (53), the second flat-plate part (52), and the second movable-side wrap (54) are sequentially integrally layered one upon the other. The first movable-side wrap (53) is formed integrally with the first flat-plate part (51). On the other hand, the second movable-side wrap (54) is formed integrally with the second flat-plate part (52). In the orbiting scroll (50), the three support rod members (61) are mounted, in a standing manner, on the upper surface of the first flat-plate part (51) formed integrally with the first movable-side wrap (53), and the second flat-plate part (52) formed integrally with the second movable-side wrap (54) is placed on the support rod members (61). And, in the orbiting scroll (50), the first flat-plate part (51), the support rod members (61), and the second flat-plate part (52) which are placed one upon the other are fastened together by bolts (62).

Figure 4:
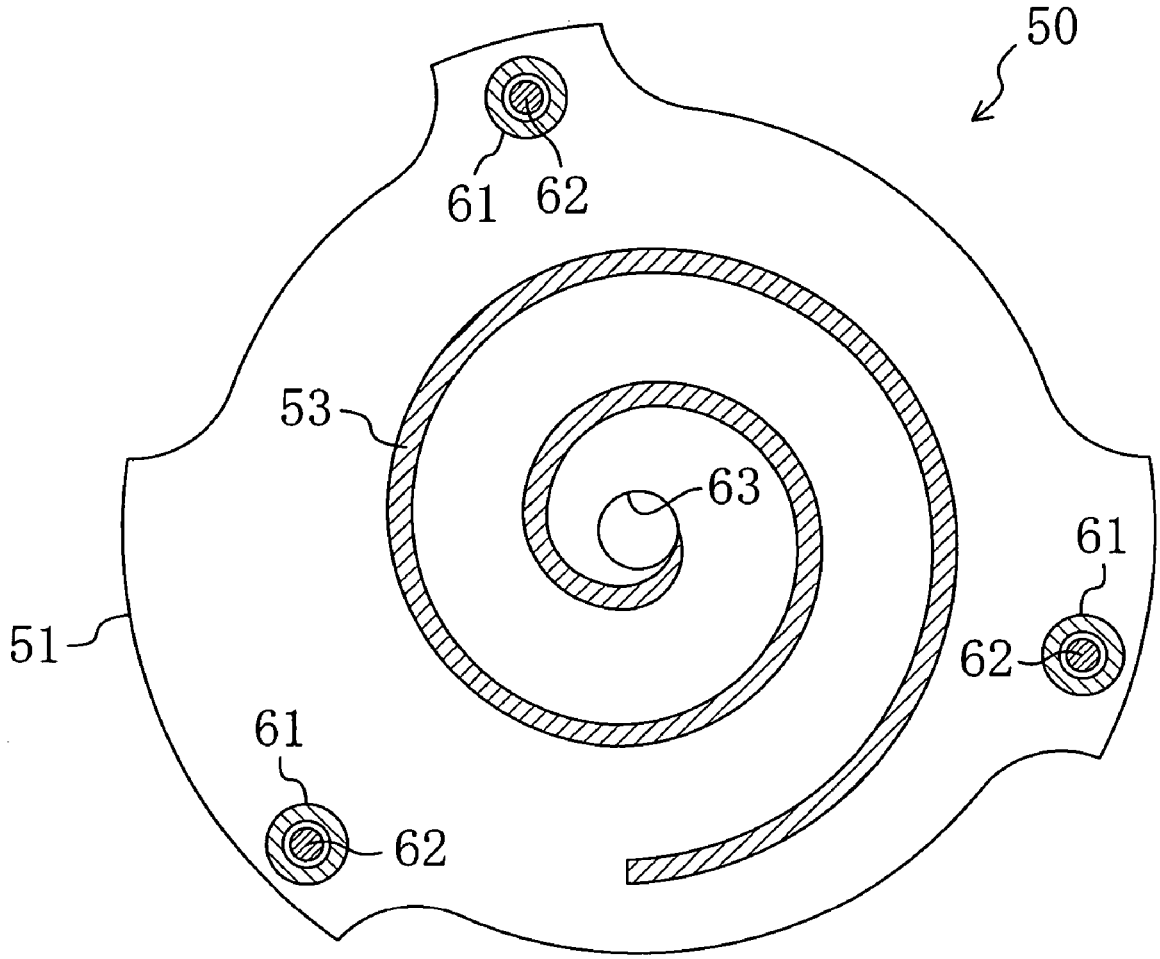
FIG. 4 is a cross sectional view showing an orbiting scroll.
Figure 5:
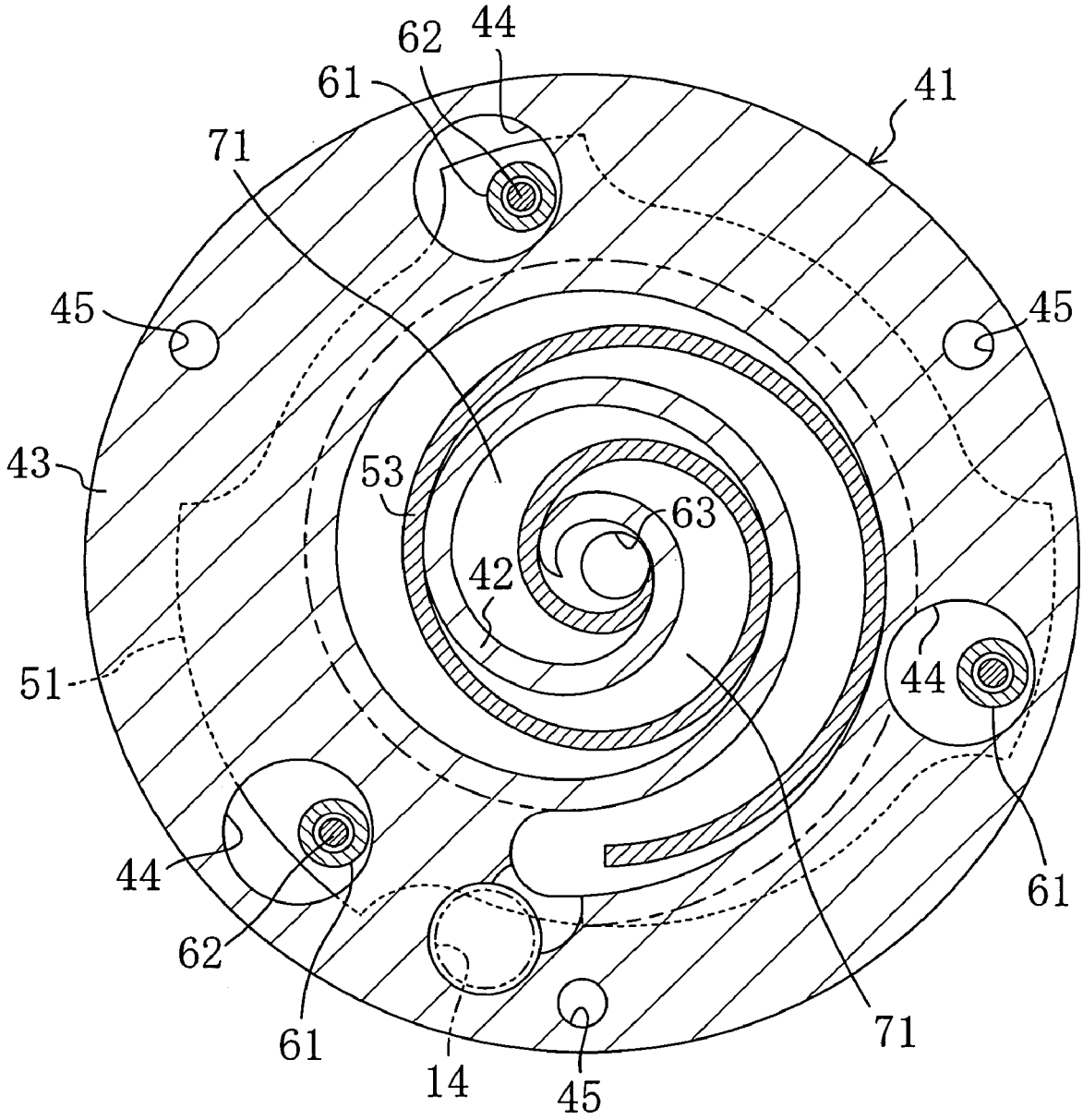
FIG. 5 is a top plan view showing the first stationary-side member and the orbiting scroll.

The first flat-plate part (51) and the first movable-side wrap (53) are described by making reference to FIGS. 2, 4, and 5. FIG. 4 is an illustration showing only the orbiting scroll (50) in a cross section taken along the line A-A of FIG. 2. And, FIG. 5 is an illustration showing the first stationary-side member (41) and the orbiting scroll (50) in a cross section taken along the line A-A of FIG. 2.

As shown in FIG. 4, the first flat-plate part (51) is shaped like a generally circular flat-plate. The front surface (upper surface in FIG. 2) of the first flat-plate part (51) is in sliding contact with the lower end surface of the first stationary-side wrap (42). The first flat-plate part (51) has three radially projecting projections. The three support rod members (61) are mounted, in a standing manner, on the three projections, respectively. Each support rod member (61) is a somewhat thick, tube-like member and is formed as a separate body from the first flat-plate part (51).

The first movable-side wrap (53) is shaped like a spiral wall the height of which is constant. The first movable-side wrap (53) is mounted, in a standing manner, on the front surface side (upper surface side in FIG. 2) of the first flat surface part. The first movable-side wrap (53) engages the first stationary-side wrap (42) of the first stationary-side member (41) (see FIG. 5). And, the side surface of the first movable-side wrap (53) is in sliding contact with the side surface of the first stationary-side wrap (42).

As shown in FIG. 2, the second flat-plate part (52) is shaped like a flat plate approximately identical in shape with the first flat-plate part (51). The rear surface (lower surface in FIG. 2) of the second flat-plate part (52) is in sliding contact with the upper end surface of the first stationary-side wrap (42) while, on the other hand, the front surface (upper surface in FIG. 2) thereof is in sliding contact with the lower end surface of the second stationary-side wrap (47).

The second movable-side wrap (54) is mounted, in a standing manner, on the front surface side (upper surface side in FIG. 2) of the second flat-plate part (52). The spiral direction of the second movable-side wrap (54) is the same as the spiral direction of the first movable-side wrap (53). In other words, the first movable-side wrap (53) and the second movable-side wrap (54) are each shaped like a right-handed spiral wall (see FIG. 4).

In the main mechanism (30), the first stationary-side wrap (42), the first movable-side wrap (53), the first flat-plate part (51), and the second flat-plate part (52) together form a first compression chamber (71). And, the first flat-plate part (51), the second flat-plate part (52) and the first movable-side wrap (53) in the orbiting scroll (50), and the first stationary-side member (41) in the fixed scroll (40) having the first stationary-side wrap (42) together form the first compression mechanism (31).

In addition, in the main mechanism (30), the second stationary-side wrap (47), the second movable-side wrap (54), the second flat-plate part (52), and the third flat-plate part (49) together form a second compression chamber (72). And, the second flat-plate part (52) and the second movable-side wrap (54) in the orbiting scroll (50), and the second stationary-side member (46) in the fixed scroll (40) having the third flat-plate part (49) and the second stationary-side wrap (47) together form the second compression mechanism (32).

Additionally, in the main mechanism (30), the compression ratio in the second compression mechanism (32) is higher than the compression ratio in the first compression mechanism (31). In other words, the ratio of maximum to minimum volume in the second compression chamber (72) is set higher than the ratio of maximum to minimum volume in the first compression chamber (71). Here, the compression ratio in the second compression mechanism (32) is set greater than the compression ratio in the first compression mechanism (31). Alternatively, the compression ratio in the second compression mechanism (32) may be set smaller than the compression ratio in the first compression mechanism (31), or the compression mechanisms (31, 32) may have the same compression ratio, depending on the use conditions of the scroll compressor (10).

Furthermore, in the main mechanism (30), the displacement volume in the second compression mechanism (32) is smaller than the displacement volume in the first compression mechanism (31). Alternatively, the displacement volume in the second compression mechanism (32) may be set greater than the displacement volume in the first compression mechanism (31), or the compression mechanisms (31, 32) may have the same displacement volume, depending on the use conditions of the scroll compressor (10).

Centrally formed in the first flat-plate part (51) of the orbiting scroll (50) is a discharge opening (63) which is a first discharge opening. The first discharge opening (63) passes through the first flat-plate part (51). In addition, a bearing part (64) is formed in the first flat-plate part (51). The bearing part (64) is formed into an approximately cylindrical shape. The bearing part (64) is formed, in a projecting manner, on the rear surface side (lower surface side in FIG. 2) of the first flat-plate part (51). Furthermore, a collar part (65) shaped like a collar is formed at the lower end of the bearing part (64).

A seal ring (38) is mounted between the lower surface of the collar part (65) of the bearing part (64) and the housing (33). A supply of high-pressure refrigeration oil is provided, through the oil feeding path of the drive shaft (20), to the inside of the seal ring (38). When high-pressure refrigeration oil is fed to the inside of the seal ring (38), oil pressure acts on the bottom surface of the collar part (65), thereby pushing the orbiting scroll (50) upwardly.

The eccentric part (21) of the drive shaft (20) is inserted into the bearing part (64) of the first flat-plate part (51). The entrance end of the discharge path (22) opens at the upper end surface of the eccentric part (21). The discharge path (22) is formed, such that its portion in the vicinity of the entrance end is slightly greater in diameter, and a tubular seal (23) and a coil spring (24) are mounted in the discharge path (22). The tubular seal (23) is shaped like a pipe whose inside diameter is slightly greater than the diameter of the first discharge opening (63). The tubular seal (23) is pressed against the rear surface of the first flat-plate part (51) by the coil spring (24). In addition, the exit end of the discharge path (22) opens at a portion of the side surface of the drive shaft (20) situated between the stator (17) and the lower bearing (19) (see FIG. 1).

An Oldham ring (39) is inserted between the first flat-plate part (51) and the housing (33). The Oldham ring (39) has a pair of keys which engage the first flat-plate part (51) and another pair of keys which engage the housing (33). And, the Oldham ring (39) forms a mechanism for preventing the orbiting scroll (50) from rotating.

Figure 6:
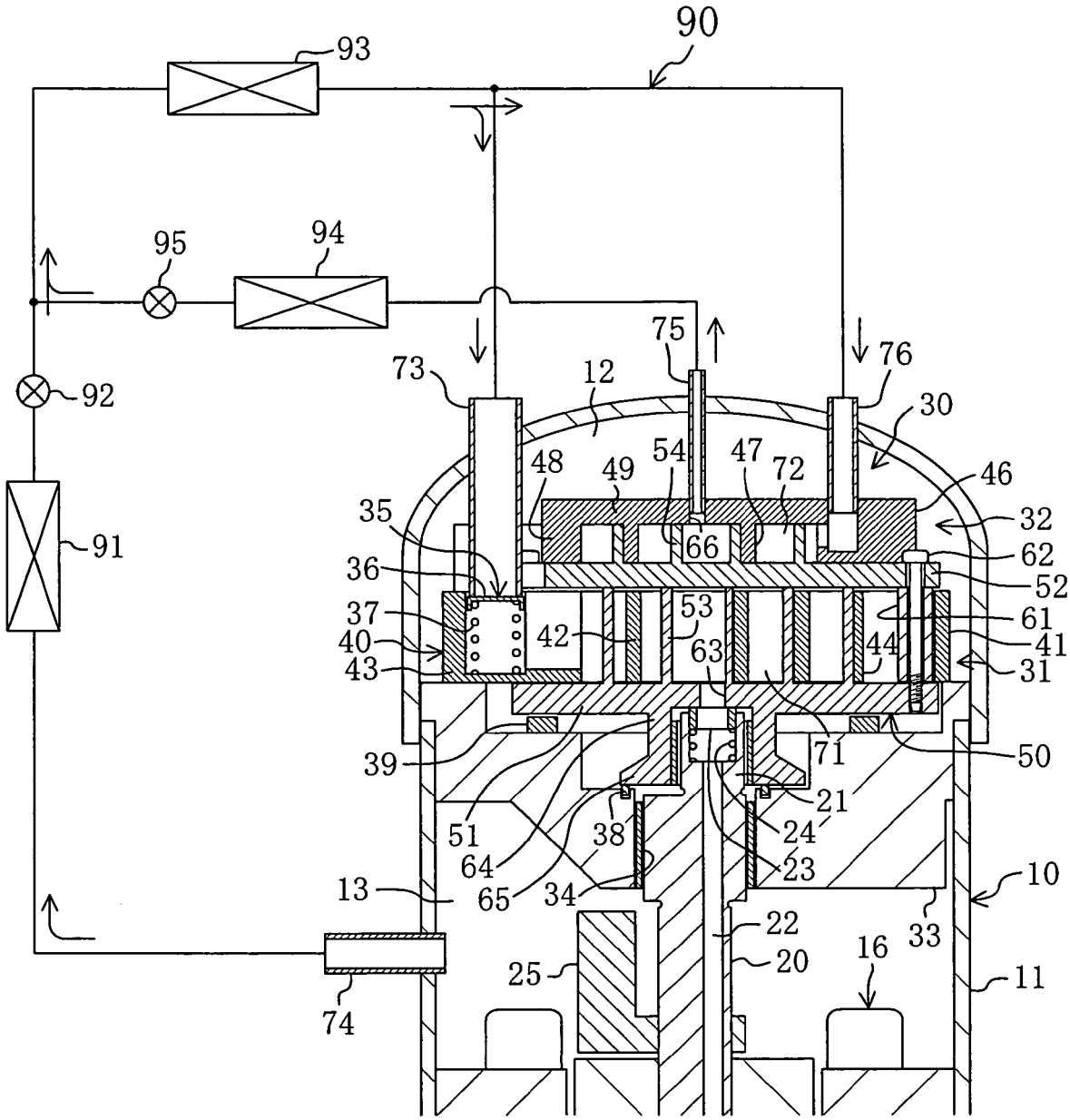
FIG. 6 is a diagram showing the arrangement of a refrigerant circuit employing the scroll compressor of FIG. 1.

As shown in FIG. 6, the scroll compressor (10) of the present embodiment is disposed in a refrigerant circuit (90) of the refrigeration apparatus. In the refrigerant circuit (90), refrigerant is circulated and as a result a vapor compression refrigeration cycle is performed.

The refrigerant circuit (90) is provided with two condensers (91, 94) and two expansion valves (92, 95). In the refrigerant circuit (90), the refrigerant condensation temperature in the second condenser (94) is set higher than the refrigerant condensation temperature in the first condenser (91).

In the refrigerant circuit (90), one end of the first condenser (91) is linked to the first discharge port (74) of the scroll compressor (10) and the other end thereof is linked to one end of the first expansion valve (92). On the other hand, one end of the second condenser (94) is linked to the second discharge port (75) of the scroll compressor (10) and the other end thereof is linked to one end of the second expansion valve (95). The other ends of the first and second expansion valves (92, 95) join and their junction is in connection with one end of an evaporator (93). The other end of the evaporator (93) is divided into branches one of which is linked to the first suction port (73) of the scroll compressor (10) and the other of which is linked to the second suction port (76) of the scroll compressor (10).

Running Operation

In the scroll compressor (10), rotational power generated by the electric motor (16) is transferred to the orbiting scroll (50) by the drive shaft (20). The orbiting scroll (50) which engages the eccentric part (21) of the drive shaft (20) is guided by the Oldham ring (39) and moves in an orbital path without rotation.

With the orbital motion of the orbiting scroll (50), low-pressure refrigerant evaporated in the evaporator (93) is drawn into the first suction port (73) and the second suction port (76). The low-pressure refrigerant flows into the first compression chamber (71) and the second compression chamber (72). As the first movable-side wrap (53) of the orbiting scroll (50) moves, the volume of the first compression chamber (71) decreases and as a result the refrigerant in the first compression chamber (71) is compressed while, on the other hand, as the second movable-side wrap (54) moves, the volume of the second compression chamber (72) decreases and as a result the refrigerant in the second compression chamber (72) is compressed.

The refrigerant compressed in the first compression chamber (71) flows, through the discharge opening (63), into the discharge path (22). Thereafter, the high-pressure refrigerant leaves the discharge path (22) and flows into the high-pressure chamber (13). Then, the high-pressure refrigerant passes through the first discharge port (74), and is discharged out of the casing (11). Meanwhile, the refrigerant compressed in the second compression chamber (72) passes through the second discharge port (75), and is discharged out of the casing (11).

In the way as described above, in the scroll compressor (10), refrigerant compressed by the first compression mechanism (31) is discharged through the first discharge port (74) while on the other hand refrigerant compressed by the second compression mechanism (32) is discharged through the second discharge port (75). The pressure of the refrigerant discharged through the second discharge port (75) is higher than the pressure of the refrigerant discharged through the first discharge port (74). The refrigerant discharged through the first discharge port (74) condenses in the first condenser (91) and thereafter is pressure-reduced by the first expansion valve (92). On the other hand, the refrigerant discharged through the second discharge port (75) condenses in the second condenser (94) and thereafter is pressure-reduced by the second expansion valve (95).

The refrigerant pressure-reduced by the first expansion valve (92) and the refrigerant pressure-reduced by the second expansion valve (95) flow into each other. Thereafter, the merged refrigerant is introduced into the evaporator (93). In the evaporator (93), the refrigerant evaporates, and thereafter the flow of the refrigerant is divided into two branch flows. One of the two refrigerant branch flows is drawn, through the first suction port (73), into the first compression chamber (71) of the first compression mechanism (31). On the other hand, the other refrigerant branch flow is drawn, through the second suction port (76), into the second compression chamber (72) of the second compression mechanism (32).

As described above, in accordance with the present embodiment, in the refrigerant circuit (90) provided with the two condensers (91, 94) having different refrigerant condensation temperatures, the refrigerant is compressed by the single scroll compressor (10), thereby making it possible to provide simplification of the refrigeration apparatus configuration.

Effects of First Embodiment

In the refrigeration apparatus of the first embodiment which is provided with the refrigerant circuit (90) having two refrigerant circulating routes (plural refrigerant circulating routes) which differ from each other in refrigerant condensation temperature, the refrigerant circuit (90) is activated by the single scroll compressor (10) having the two compression mechanisms (31, 32). And, since the first compression mechanism (31) and the second compression mechanism (32) differ from each other in compression ratio and displacement volume, this makes it possible to supply each refrigerant circulating route with refrigerant at a respective suitable pressure and at a respective suitable circulation amount. As a result, it becomes possible for the apparatus to efficiently operate with smaller loss. In addition, since only the single scroll compressor (10) is provided, this accomplishes install-space savings and the apparatus cost is also cut down.

Furthermore, the first embodiment employs the scroll compressor (10) formed by the two-tiered compression mechanisms (31, 32), and this scroll compressor (10) is realized by the addition of only the second flat-plate part (52) provided with the second movable-side wrap (54), the second stationary-side member (46), the second suction port (76) and the second discharge port (75), to a conventional scroll compressor having, as a compression mechanism, only the first compression mechanism (31), i.e., a scroll compressor in which the second flat-plate part (52) is not provided with the second movable-side wrap (54) and neither of the second stationary-side member (46), the second suction port (76), and the second discharge port (75) are provided. Accordingly, the share of component parts with the conventional scroll compressor becomes possible, thereby cutting down the cost.

In addition, even if the compression ratio of either one of the routes is high and as a result the temperature of discharge gas becomes high, heat generated in the upper and lower compression chambers (71, 72) is transferred through the flat-plate part (52) positioned therebetween. This lessens the rise in temperature. Therefore, improvements in apparatus reliability are accomplished.

Second Embodiment of Invention

Figure 7:
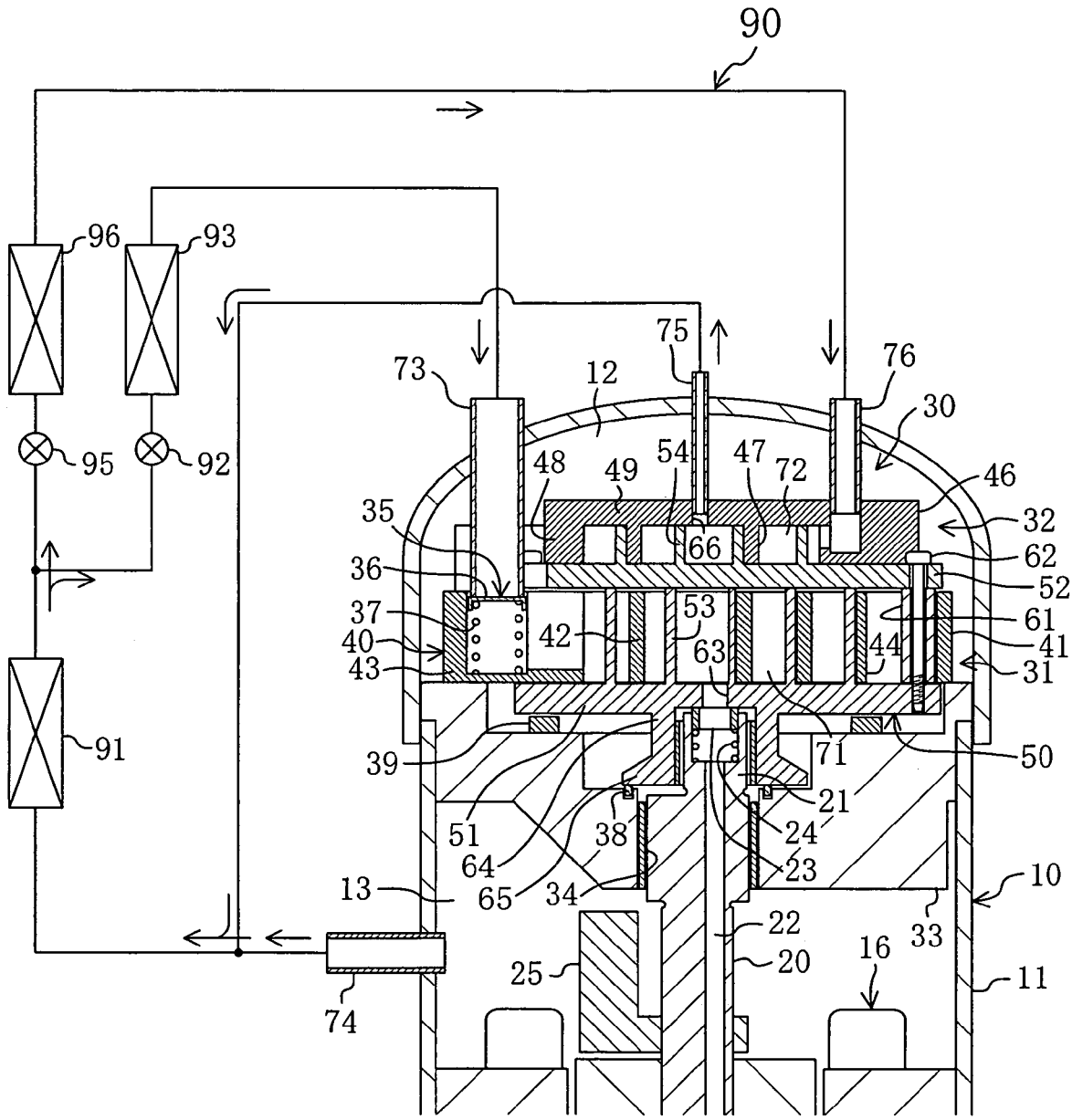
FIG. 7 is a diagram showing the arrangement of a refrigerant circuit of a second embodiment of the present invention.

A second embodiment of the present invention is described. As shown in FIG. 7, the second embodiment differs from the first embodiment in configuration of the refrigerant circuit (90). The configuration of the scroll compressor (10) is the same as in the first embodiment. Accordingly, only the configuration of the refrigerant circuit (90) is described below.

The refrigerant circuit (90) of the second embodiment is provided with two expansion valves (92, 95) and two evaporators (93, 96). In the refrigerant circuit (90), the temperature at which refrigerant evaporates in the second evaporator (96) is so set as to be lower than the temperature at which refrigerant evaporates in the first evaporator (93).

In the refrigerant circuit (90), the first and second discharge ports (74, 75) of the scroll compressor (10) join and their junction is linked to one end of the condenser (91). The other end of the condenser (91) is divided into branches one of which is linked to the first expansion valve (92) and the other of which is linked to the second expansion valve (95). One end of the first evaporator (93) is linked to the first expansion valve (92) while the other end thereof is linked to the first suction port (73) of the scroll compressor (10). One end of the second evaporator (96) is linked to the second expansion valve (95) while the other end thereof is linked to the second suction port (76) of the scroll compressor (10).

In the scroll compressor (10), refrigerant compressed by the first compression mechanism (31) is discharged through the first discharge port (74) while on the other hand refrigerant compressed by the second compression mechanism (32) is discharged through the second discharge port (75). The pressure of the refrigerant discharged through the first discharge port (74) and the pressure of the refrigerant discharged through the second discharge port (75) are the same. The refrigerant discharged through the first discharge port (74) and the refrigerant discharged through the second discharge port (75) condense in the condenser (91). After leaving the condenser (91), the flow of the condensed refrigerant is divided into two branch flows.

One of the two refrigerant branch flows is pressure-reduced by the first expansion valve (92), evaporates in the first evaporator (93), and is drawn, through the first suction port (73), into the first compression chamber (71) of the first compression mechanism (31). Meanwhile, the other refrigerant branch flow is pressure-reduced in the second expansion valve (95), evaporates in the second evaporator (96), and is drawn, through the second suction port (76), into the second compression chamber (72) of the second compression mechanism (32). At that time, in the refrigerant circuit (90), the degree of opening of the second expansion valve (95) is set smaller than that of the first expansion valve (92), and the refrigerant evaporation pressure in the second evaporator (96) is set lower than that in the first evaporator (93).

In the refrigeration apparatus of the second embodiment provided with the refrigerant circuit (90) having two refrigerant circulating routes (plural refrigerant circulating routes) which differ from each other in refrigerant evaporation temperature, the refrigerant circuit (90) is activated by the single scroll compressor (10) having the two compression mechanisms (31, 32). And, since the first compression mechanism (31) and the second compression mechanism (32) differ in compression ratio and displacement volume, this makes it possible to supply each refrigerant circulating route with refrigerant at a respective suitable pressure and at a respective suitable circulation amount. As a result, it becomes possible for the apparatus to efficiently operate with smaller loss. In addition, since only the single scroll compressor (10) is provided, this accomplishes install-space savings and the apparatus cost is also cut down.

Variation of Second Embodiment

Figure 8:
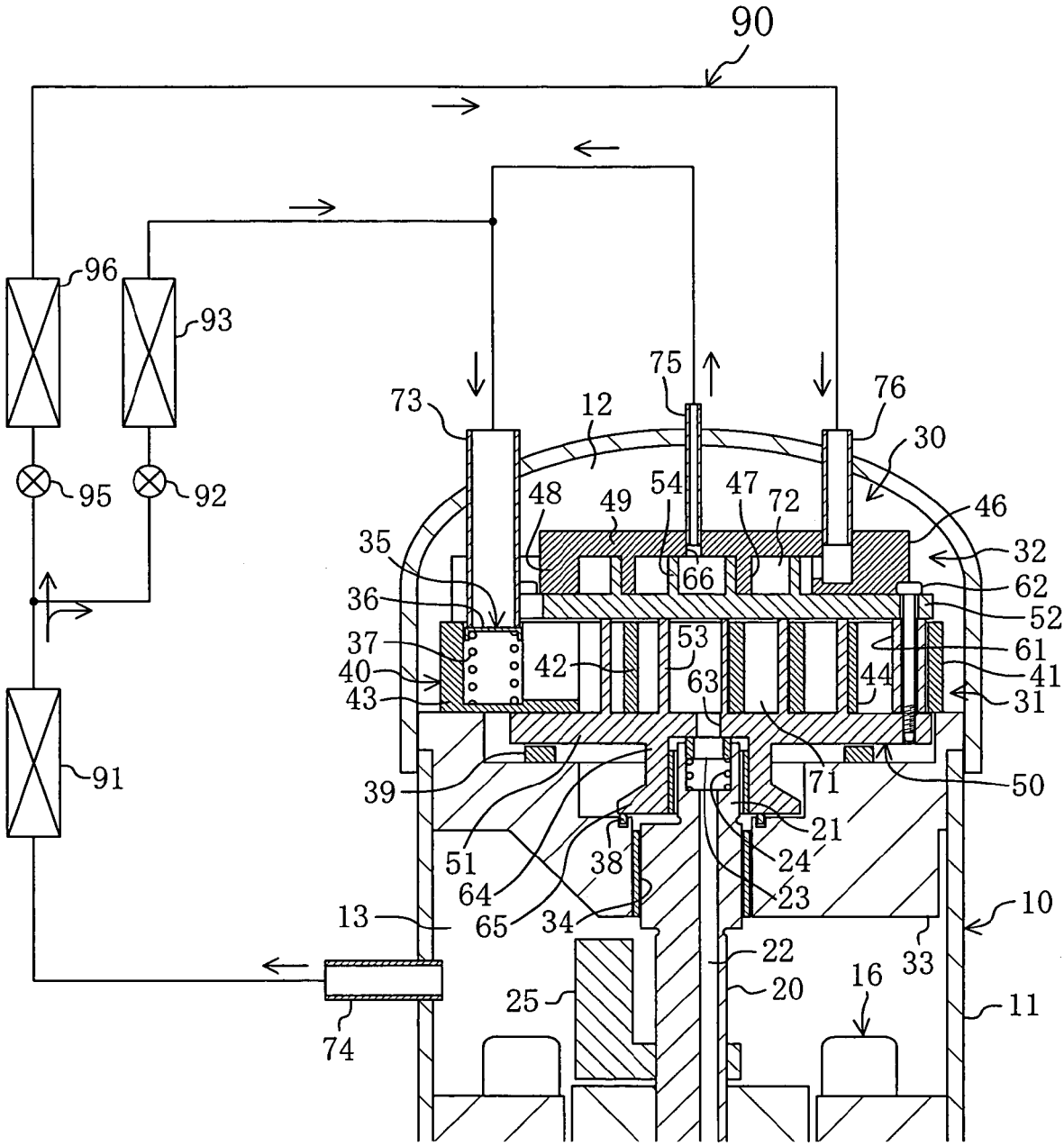
FIG. 8 is a diagram showing the arrangement of a refrigerant circuit according to a first variation of the second embodiment.

In the second embodiment, the refrigerant circuit (90) may be arranged as shown in FIG. 8.

The refrigerant circuit (90) of the present variation is also provided with two expansion valves (92, 95) and two evaporators (93, 96). In addition, like the example of FIG. 7, the refrigerant evaporation temperature in the second evaporator (96) is set lower than that in the first evaporator (93).

In the present variation, the first discharge port (74) of the scroll compressor (10) is linked to one end of the condenser (91). The other end of the condenser (91) is divided into two branches one of which is linked to the first expansion valve (92) and the other of which is linked to the second expansion valve (95). One end of the first evaporator (93) is linked to the first expansion valve (92) while the other end thereof is linked to the first suction port (73) of the scroll compressor (10). One end of the second evaporator (96) is linked to the second expansion valve (95) while the other end thereof is linked to the second suction port (76) of the scroll compressor (10). In addition, the second discharge port (75) of the scroll compressor (10) is linked to a suction pipe extending between the first evaporator (93) and the first suction port (73).

In the present variation, for example 90% of the total amount of refrigerant circulation in the refrigerant circuit (90) flows through the first evaporator (93) and the rest (10%) flows through the second evaporator (96).

In the scroll compressor (10), refrigerant compressed by the first compression mechanism (31) is discharged through the first discharge port (74) while on the other hand refrigerant compressed by the second compression mechanism (32) is discharged through the second discharge port (75). The pressure of the refrigerant discharged through the first discharge port (74) is higher than the pressure of the refrigerant discharged through the second discharge port (75). The refrigerant discharged through the first discharge port (74) condenses in the condenser (91). After leaving the condenser (91), the flow of the condensed refrigerant is divided into two branch flows.

One of the two refrigerant branch flows is pressure-reduced by the first expansion valve (92), evaporates in the first evaporator (93), and merges with the flow of the refrigerant discharged through the second discharge port (75). Thereafter, the merged refrigerant is drawn, through the first suction port (73), into the first compression chamber (71) of the first compression mechanism (31). Meanwhile, the other refrigerant branch flow, divided downstream of the condenser (91), is pressure-reduced by the second expansion valve (95), evaporates in the second evaporator (96), and is drawn, through the second suction port (76), into the second compression chamber (72) of the second compression mechanism (32). At that time, in the refrigerant circuit (90), the degree of opening of the second expansion valve (95) is set smaller than that of the first expansion valve (92), and the refrigerant evaporation pressure in the second evaporator (96) is set lower than that in the first evaporator (93). In addition, the refrigerant discharged through the second discharge port (75) is drawn, through the first suction port (73), into the first compression mechanism (31), in other words it undergoes two-stage compression.

In the refrigeration apparatus of the variation of the second embodiment provided with the refrigerant circuit (90) having two refrigerant circulating routes (plural refrigerant circulating routes) which differ from each other in refrigerant evaporation temperature, the refrigerant circuit (90) is activated by the single scroll compressor (10) having the two compression mechanisms (31, 32). And, since the first compression mechanism (31) and the second compression mechanism (32) differ in compression ratio and displacement volume, this makes it possible to supply each refrigerant circulating route with refrigerant at a respective suitable pressure and at a respective suitable circulation amount. As a result, it becomes possible for the apparatus to efficiently operate with smaller loss. In addition, since only the single scroll compressor (10) is provided, this accomplishes install-space savings and the apparatus cost is also cut down.

Additionally, for the case of the example of FIG. 7, when the difference between the first evaporation temperature and the second evaporation temperature is substantial (for example, when the refrigerant circuit (90) is applied to a cold storage/frozen storage mode of operation or to an air-conditioning/frozen storage mode of operation), the required compression ratio of the second compression mechanism (32) increases. Consequently, the amount of refrigerant leakage is liable to increase. In addition, the discharge temperature is liable to become excessively high. However, the variation of FIG. 8 employs two-stage compression, so that the second compression mechanism (32) is no longer required to operate at excessively great compression ratios. Consequently, the amount of refrigerant leakage is held low. Besides, an excessive rise in temperature is also suppressed by mixing of discharge gas from the second compression mechanism (32) and suction gas to the first compression mechanism (31). In addition, if the discharge temperature of the second compression mechanism (32) rises to excessive levels, this contributes to the degradation of refrigerant gas and lubrication oil. However, such a problem can be avoided.

On the other hand, the required compression ratio of the second compression mechanism (32) does not become too high, when the difference between the first evaporation temperature and the second evaporation temperature is small. If two-stage compression is employed as shown in FIG. 8, the discharge loss becomes a problem. To cope with such a case, the configuration of FIG. 7 may be employed.

Figure 9:
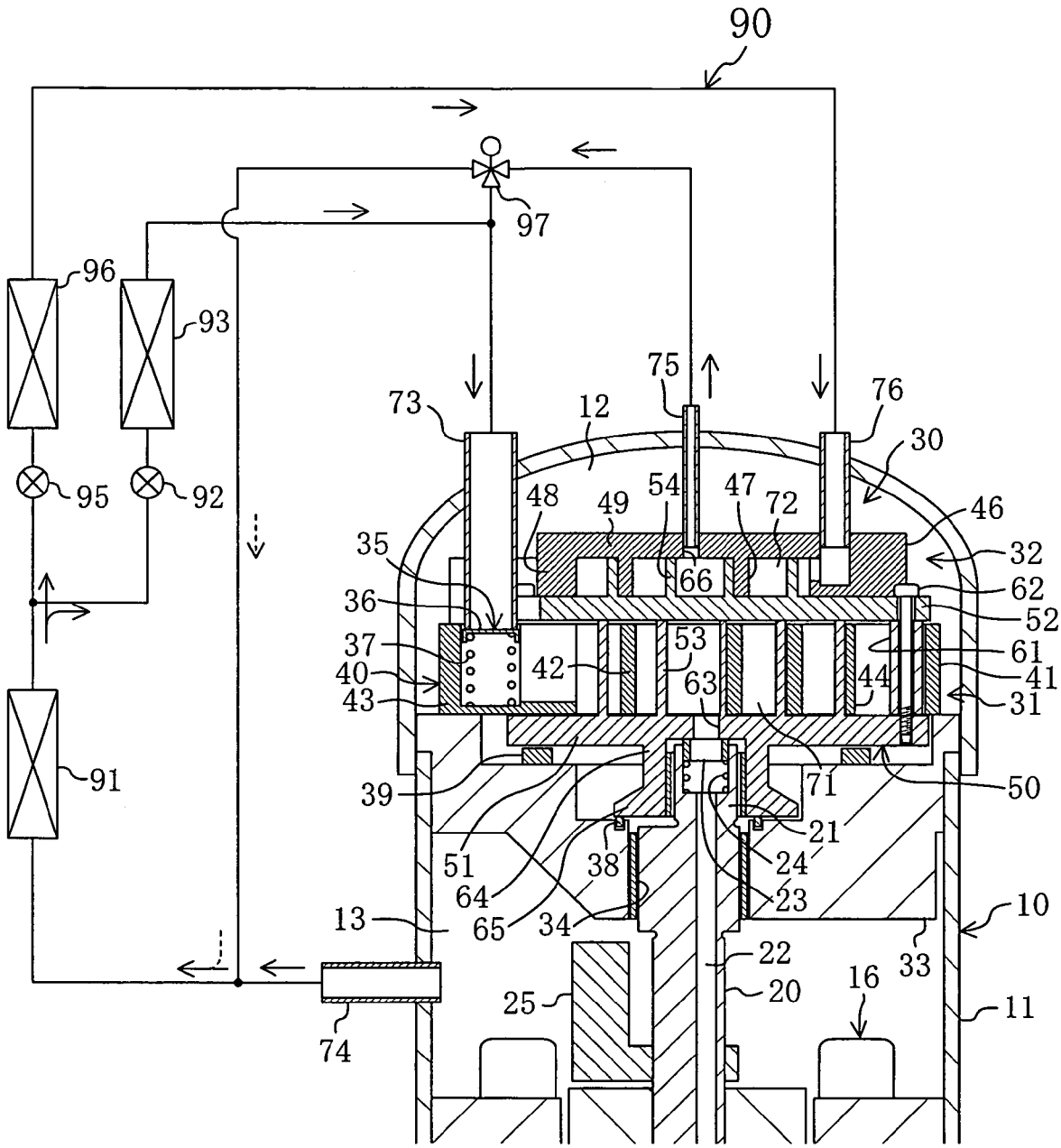
FIG. 9 is a diagram showing the arrangement of a refrigerant circuit according to a second variation of the second embodiment.

Therefore, the refrigerant circuit (90) may be configured, such that it becomes switchable between the circuit of FIG. 7 and the circuit of FIG. 8, as shown in FIG. 9. In this example, in the refrigerant circuit (90) of FIG. 8, a three-way switching valve (97) is disposed short of the junction of a discharge pipe linked to the second discharge port (75) with a suction pipe extending between the first evaporator (93) and the first suction port (73). The three-way switching valve (97) is linked to a discharge pipe in connection with the first discharge port (74).

As a result of such arrangement, switching between the refrigerant circuit (90) of FIG. 7 and the refrigerant circuit (90) of FIG. 8 is made adequately for the operation of the apparatus. Operations according to the operational status of the refrigerant circuit are performed.

Third Embodiment of Invention

A third embodiment of the present invention is described. The scroll compressor (10) of the third embodiment is an example which differs in configuration of the main mechanism (30) from the first and second embodiments.

Figure 10:
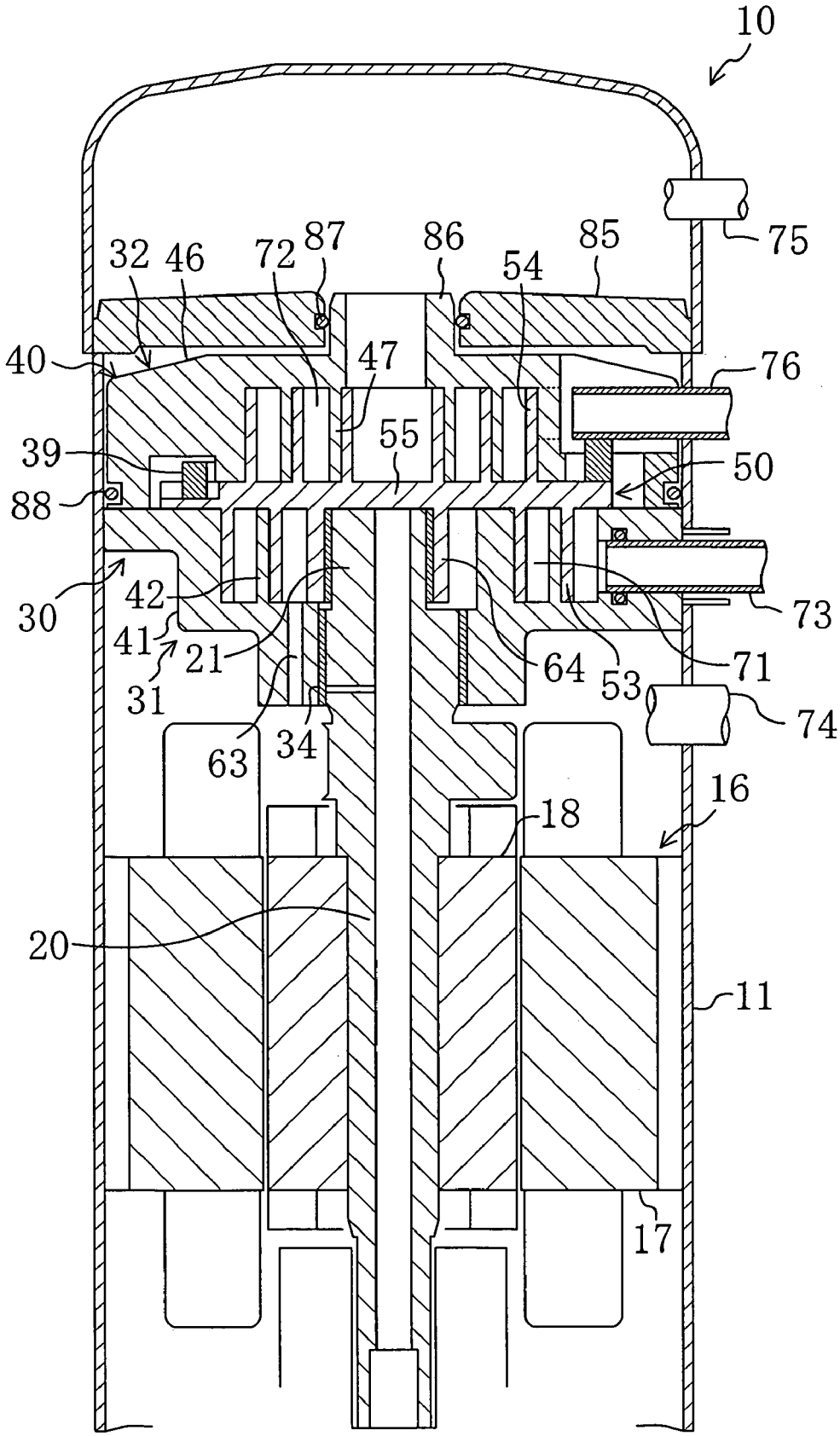
FIG. 10 is a partial cross sectional view of a scroll compressor of a third embodiment of the present invention.
Figure 11:
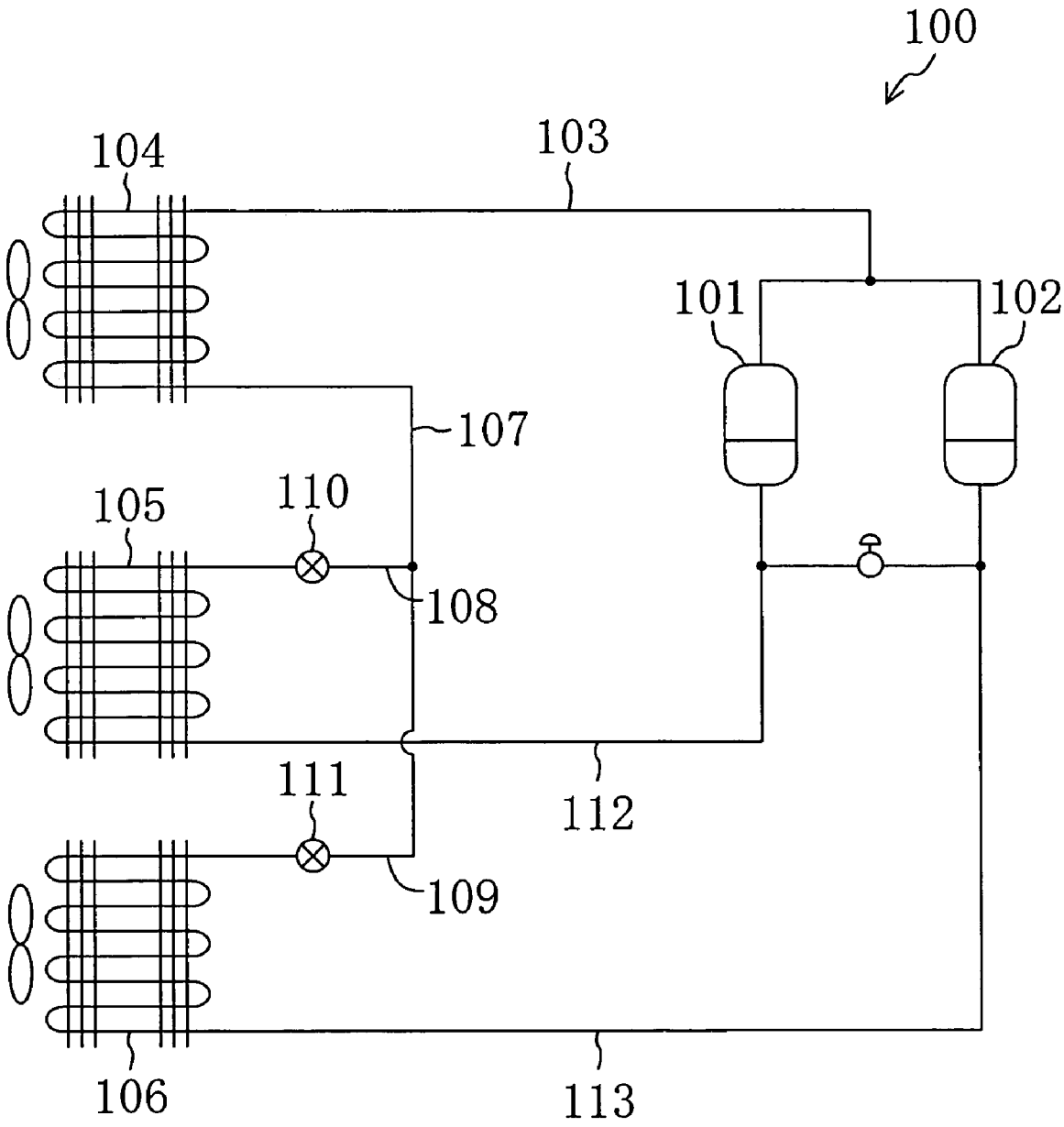
FIG. 11 is a refrigerant circuit diagram of a conventional refrigeration apparatus.

A main mechanism (30) of the third embodiment includes an orbiting scroll (50) of a so-called double-toothed type. As shown in FIG. 10, the orbiting scroll (50) has a single flat-plate part (55), a first movable-side wrap (53) formed in the lower surface of the flat-plate part (55), and a second movable-side wrap (54) formed in the upper surface of the flat-plate part (55). A bearing part (64) is formed in the lower surface of the flat-plate part (55) of the orbiting scroll (50). An eccentric part (21) of a drive shaft (20) is inserted into the bearing part (64).

A fixed scroll (40) includes a first stationary-side member (41) firmly attached to a casing (11) at a position below the orbiting scroll (50), and a second stationary-side member (46) firmly attached to the upper surface of the first stationary-side member (41). A first stationary-side wrap (42) with which the first movable-side wrap (53) is brought into engagement is formed in the first stationary-side member (41). A second stationary-side wrap (47) with which the second movable-side wrap (54) is brought into engagement is formed in the second stationary-side member (46). The first stationary-side member (41) and the orbiting scroll (50) together form a first compression chamber (71) of a first compression mechanism (31). The second stationary-side member (46) and the orbiting scroll (50) together form a second compression chamber (72) of a second compression mechanism (32). The first compression mechanism (31) and the second compression mechanism (32) differ in compression ratio and displacement volume, as in the first and second embodiments.

Mounted between the second stationary-side member (46) and the orbiting scroll (50) is an Oldham ring (39) for preventing the orbiting scroll (50) from rotating. In addition, the first stationary-side member (41) has a main bearing (34) and the drive shaft (20) is rotatably supported by the main bearing (34).

In the inside of the casing (11), a partition plate (85) is fixedly disposed immediately above the main mechanism (30). An upper end (86) of the second stationary-side member (46) is inserted into the partition plate (85). An O-ring (87) is mounted around the upper end (86) in the partition plate (85). The O-ring (87) provides sealing between spaces defined above and below the partition plate (85). In addition, an O-ring (88) is mounted around the outer peripheral surface of the second stationary-side member (46). The O-ring (88) provides sealing between spaces defined above and below the second stationary-side member (46).

The casing (11) is provided with a first suction port (73) in communication with the first compression chamber (71) through the first stationary-side member (41), and a second suction port (76) in communication with the second compression chamber (72) through the second stationary-side member (46). Additionally, the casing (11) is provided with a first discharge port (74) through which refrigerant flowing out to the space below the first stationary-side member (41) through the first compression chamber (71) and then through the first discharge opening (63) is discharged, and a second discharge port (75) through which refrigerant flowing out to the space above the partition plate (85) through the second compression chamber (72) and then through the second discharge opening (66) is discharged.

Other configurations are almost the same as each of the above-described embodiments, and their description is omitted accordingly. The same reference numerals as the first and second embodiments indicate the same structural members as the first and second embodiments.

Although diagrammatical representation of a refrigerant circuit employing the scroll compressor (10) of the present embodiment is omitted, it is applicable to the refrigerant circuit (90) with the two condensers (91, 94) differing in refrigerant condensation temperature in the first embodiment (FIG. 6) and to the refrigerant circuit (90) with the two evaporators (93, 96) differing in refrigerant evaporation temperature in the second embodiment (FIGS. 7 through 9).

And, also in the third embodiment, the refrigerant circuit (90) is activated by the single scroll compressor (10) having the two compression mechanisms (31, 32) in the refrigeration apparatus provided with the refrigerant circuit (90) having two refrigerant circulating routes (plural refrigerant circulating routes) differing in refrigerant condensation temperature and/or refrigerant evaporation temperature. And, since the first compression mechanism (31) and the second compression mechanism (32) differ in compression ratio and displacement volume, this makes it possible to supply each refrigerant circulating route with refrigerant at a respective suitable pressure and at a respective suitable circulation amount. As a result, it becomes possible for the apparatus to efficiently operate with smaller loss. In addition, since only the single scroll compressor (10) is provided, this accomplishes install-space savings and the apparatus cost is also cut down.

Furthermore, in accordance with the third embodiment, it employs the orbiting scroll (50) having the first movable-side wrap (53) formed in a standing manner on one surface of the flat-plate part (55) and the second movable-side wrap (54) formed in a standing manner on the other surface of the flat-plate part (55). As a result of such arrangement, the number of component parts is reduced and the cost can be cut down. In addition, thrust loads act above and blow the flat-plate part (55) of the orbiting scroll (50), but they act in opposite directions. Therefore, in comparison with conventional scroll compressors having a movable wrap on only one side, thrust bearing loss is lessened and the efficiency is high.

In addition, even if the compression ratio of either one of the routes is high and as a result the temperature of discharge gas becomes high, heat generated in the upper and lower compression chambers (71, 72) is transferred through the flat-plate part (52) positioned therebetween. This lessens the rise in temperature. Therefore, improvements in apparatus reliability is accomplished.

Other Embodiments

The present invention may be configured as follows with respect to the above-described embodiments.

For example, in each of the above-described embodiments, the description has been made in terms of a scroll compressor having two compression mechanisms (31, 32) in the inside of the single casing. Alternatively, the present invention is applicable to displacement compressors other than the scroll compressors.

In addition, with respect to the configuration in which the two scroll-type compression mechanism (31, 32) are provided in the inside of the single casing (11), each of the above-described embodiments are only examples. Adequate modifications may be made.

Furthermore, the present invention is applicable to cases wherein, in a refrigerant circuit provided with three or more refrigerant circulating routes having their respective refrigerant condensation temperatures and refrigerant condensation temperatures, two of the three or more refrigerant circulating routes are activated. In addition, in the above-described embodiments, the description has been made in terms of an example in which the present invention is applied to a refrigerant circuit provided with two refrigerant circulating routes having the same refrigerant condensation or evaporation temperature. Alternatively, the present invention is applicable to a refrigerant circuit provided with two refrigerant circulating routes differing in refrigerant condensation temperature as well as in refrigerant evaporation temperature (i.e., a refrigerant circuit in which the entrance and exit sides of the first and second compression mechanisms (31, 32) have their respective differing pressures (temperatures)).

Additionally, the two compression mechanisms (31, 32) which are disposed within the single casing (11) do not necessarily have different compression ratios or different displacement volumes, and it may be so designed as to cope with the difference in refrigerant evaporation temperature by control by means of an expansion valve or the like.

INDUSTRIAL APPLICABILITY

As has been described above, the present invention is usefully applicable to a refrigeration apparatus provided with a refrigerant circuit having a plurality of refrigerant circulating routes and capable of operation in a mode where the refrigerant circulating routes differ from each other in refrigerant evaporation temperature and/or refrigerant condensation temperature.

What is claimed is:

1. A refrigeration apparatus provided with a refrigerant circuit having a plurality of refrigerant circulating routes and capable of operation in a mode where the plurality of refrigerant circulating routes differ in at least one of refrigerant evaporation temperature and refrigerant condensation temperature, wherein a compressor of the refrigerant circuit comprises a single casing in which a first compression mechanism linked to a first refrigerant circulating route and a second compression mechanism linked to a second refrigerant circulating route are arranged.

2. The refrigeration apparatus of claim 1, wherein the first and second compression mechanisms differ from each other in compression ratio.

3. The refrigeration apparatus of claim 1, wherein the first and second compression mechanisms differ from each other in displacement volume.

4. The refrigeration apparatus of claim 1, wherein:

the first and second compression mechanisms are scroll compression mechanisms, an orbiting scroll integrated by sequentially layering a first flat-plate part, a first movable-side wrap, a second flat-plate part and a second movable-side wrap, and a fixed scroll having a first stationary-side wrap which engages the first movable-side wrap and a second stationary-side wrap which engages the second movable-side wrap are provided, the first stationary-side wrap and the first movable-side wrap together form the first compression mechanism, and the second stationary-side wrap and the second movable-side wrap together form the second compression mechanism.

5. The refrigeration apparatus of claim 1, wherein:

the first and second compression mechanisms are scroll compression mechanisms, an orbiting scroll having a first movable-side wrap formed in standing manner on one surface of a flat-plate part and a second movable-side wrap formed in standing manner on the other surface of the flat-plate part, and a fixed scroll having a first stationary-side wrap which engages the first movable-side wrap and a second stationary-side wrap which engages the second movable-side wrap are provided, the first stationary-side wrap and the first movable-side wrap together form the first compression mechanism, and the second stationary-side wrap and the second movable-side wrap together form the second compression mechanism.

6. The refrigeration apparatus of claim 1, wherein:

the first and second compression mechanisms are scroll compression mechanisms.

7. The refrigeration apparatus of claim 1, wherein:

the first and second compression mechanisms are displacement compression mechanisms.

* * * * *